US005218330A

United States Patent [19]

Omiya et al.

[11] Patent Number: 5,218,330

[45] Date of Patent: Jun. 8, 1993

[54] APPARATUS AND METHOD FOR EASILY ADJUSTING THE RESONANT FREQUENCY OF A DIELECTRIC TEM RESONATOR

[75] Inventors: Kenzi Omiya, Nasu; Hideo Sugawara, Otawara; Hiroshi Suzuki; Hirokazu Ueda, both of Otawara, all of Japan

[73] Assignee: Fujitsu Limited, Kawasaki, Japan

[21] Appl. No.: 701,112

[22] Filed: May 17, 1991

[30] Foreign Application Priority Data

May 18, 1990 [JP] Japan ..... 2-126775
May 25, 1990 [JP] Japan ..... 2-133852

[51] Int. Cl.[5] ..... H01P 7/04
[52] U.S. Cl. ..... 333/223; 333/224
[58] Field of Search ..... 333/202, 206, 207, 219, 333/219.1, 222-226, 235

[56] References Cited

U.S. PATENT DOCUMENTS 4,271,399 6/1981 Morita ..... 333/202 X
4,434,410 2/1984 Miyake et al. ..... 333/224
4,583,064 4/1986 Makimoto et al. ..... 333/235 X
4,631,506 12/1986 Makimoto et al. ..... 333/224

FOREIGN PATENT DOCUMENTS 58-90701 6/1983 Japan .
61-174202 10/1986 Japan .
0275202 11/1988 Japan ..... 333/222

*Primary Examiner*—Robert J. Pascal
*Assistant Examiner*—Seung Ham
*Attorney, Agent, or Firm*—Staas & Halsey

[57] ABSTRACT

A dielectric TEM resonator, whose resonant frequency is adjustable in both directions after being incorporated in a circuit, is disclosed. A first dielectric TEM resonator comprises a metal member disposed near an open end of a resonator body and coupled to an inner or outer conductor of the resonator body. The resonant frequency is adjusted by adjusting a distance between the open end and the metal member. A dielectric material of a second dielectric TEM resonator is partially exposed, and a dielectric board for mounting the resonator body is also exposed in a corresponding part to the exposed part of the dielectric material. The exposed part of the dielectric board is partially covered with a metal plate. The resonant frequency is adjusted by adjusting the covered area.

22 Claims, 9 Drawing Sheets

APPARATUS AND METHOD FOR EASILY ADJUSTING THE RESONANT FREQUENCY OF A DIELECTRIC TEM RESONATOR

BACKGROUND OF THE INVENTION

1. Field of the Invention

The present invention relates to a dielectric TEM resonator used in a filter or oscillator for radio equipment, and an adjusting method thereof.

The dielectric TEM resonator is used in circuits operating in a several hundred megahertz to several gigahertz band as a compact and low price resonator. As a resonant frequency of the resonator is determined by the effective length of the resonator, some fine adjustments are necessary after incorporation into the circuit. In this specification, a dielectric TEM resonator, wherein these adjustments are easily performed, and a method for adjusting the resonator, are disclosed.

2. Description of the Related Art

A dielectric TEM resonator comprises coaxial inner and outer conductors and a dielectric material filling a space between the inner and outer conductors. At one end of the axially elongated resonator, the resonator is opened and this end of the inner conductor is coupled with other circuit elements. At the other end of the resonator, the resonator is opened to form a $\lambda g/2$ type resonator, or is shortened by coupling the ends of the outer and inner conductors in a $\lambda g/4$ type resonator.

In both types, a resonant frequency of the resonator is determined by its axial length which is typically determined by the axial length of the dielectric material. Generally, dimensional accuracy of the dielectric material is not satisfactory. Also, effective length of the resonator is affected by the shape of an element coupling the inner conductor with the other circuit elements. Therefore, the resonant frequencies of the resonators must be adjusted in individual products after the resonators are mounted in the circuits.

Conventionally, this adjustment has been performed by shaving off the outer conductor at the open end of the resonator with a file, etc. Having been shaved off, lines of electric force at the open end of the resonator are bent toward the inside, and thus the effective length of the resonator is shortened.

However, the adjustment by shaving-off is not only troublesome, but also has the problem that the resonant frequency can be adjusted only so as to elevate the frequency, and thus inferior products are generated when the resonators are over-shaved.

SUMMARY OF THE INVENTION

It is an object of the present invention to provide an easily adjustable dielectric resonator and an adjusting method thereof, wherein a resonant frequency of the resonator can be easily altered so that the frequency can not only be elevated, but also lowered.

In accordance with the present invention, there is provided a dielectric resonator, comprising first conductor means, for operating as an inner conductor of the dielectric resonator, second conductor means, forming a space between the first and second conductor means, for operating as an outer conductor of the dielectric resonator, dielectric means filling the space between the first and second conductor means, for forming a resonator body having at least one open end, cooperating with the first and second conductor means, and third conductor means, disposed near the open end of the resonator body and electrically connected to the first or second conductor means, wherein a distance between the open end and at least a part of the third conductor means is adjustable to adjust a resonant frequency of the dielectric resonator.

By disposing the third conductor means near the open end of the resonator body, lines of electric force near the open end extend to the third conductor means, and thus, an effective length of the resonator becomes a length determined by a distance between the third conductor means and the open end. Therefore, the resonant frequency of the resonator can be easily adjusted in both directions by adjusting the distance.

In accordance with the present invention there is also provided a dielectric resonator, comprising first conductor means, for operating as an inner conductor of the dielectric resonator, second conductor means, forming a space between the first and second conductor means, for operating as an outer conductor of the dielectric resonator, dielectric means filling the space between the first and second conductor means, for forming a resonator body, cooperating with the first and second conductor means, a dielectric board for mounting the resonator body, and a first conductor pattern covering a side of the dielectric board opposite to the resonator body, wherein the dielectric means are exposed out of the second conductor means in a first part of a face of the resonator body facing toward the dielectric board, near an end face of the resonator body, wherein the dielectric board is exposed out of the first conductor pattern in a second part corresponding to the first exposed part, and wherein the dielectric resonator further comprises third conductor means, covering at least a part of the second exposed part, and electrically connected to the first conductor pattern.

In accordance with the present invention, there is also provided an adjusting method of a dielectric resonator comprising the steps of:

i) providing a resonator body comprising an inner conductor, an outer conductor, and a dielectric material filling a space between the inner and outer conductors, ii) providing a conductor member disposed near an open end of the resonator body and coupled to the inner or outer conductor, and iii) adjusting a distance between the open end and at least a part of the conductor member to adjust a resonant frequency of the resonator.

In accordance with the present invention there is also provided an adjusting method of a dielectric resonator comprising the steps of:

i) preparing a resonator body comprising an inner conductor, an outer conductor, and a dielectric material filling a space between the inner and outer conductor, wherein the dielectric material is exposed out of the outer conductors in a part of a face of the resonator body, ii) preparing a dielectric board having a conductor pattern covering a side of the dielectric board wherein the dielectric board is exposed out of the conductor pattern in a part of the side of the dielectric board.

iii) mounting the resonator body on the side of the dielectric board opposite to the side covered with the conductor pattern, so that the exposed part of the dielectric material overlaps the exposed part of the dielectric board, iv) covering at least a part of the exposed part of the dielectric board with a conductor plate coupled to the conductor pattern, and v) adjusting the covered area of the exposed part of the dielectric board to adjust a resonant frequency of the dielectric resonator.

DESCRIPTION OF THE PREFERRED EMBODIMENTS

Before describing the preferred embodiments according to the invention, examples of aforementioned related art are given with reference to the accompanying drawings.

Figure 1:
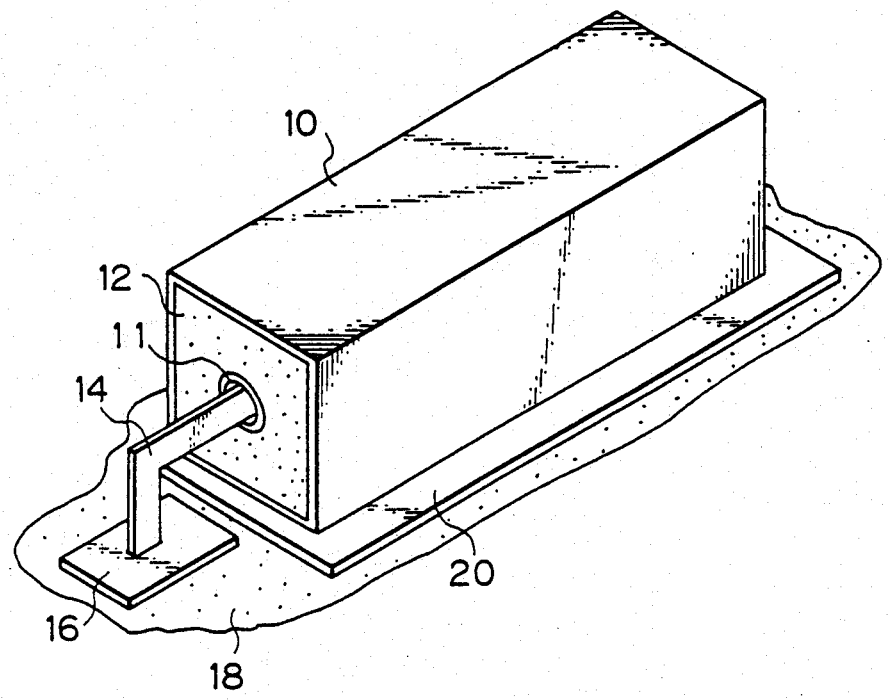
Fig. 1 PRIOR ART
FIG. 1 is a perspective view of a conventional dielectric TEM resonator.
Figure 2:
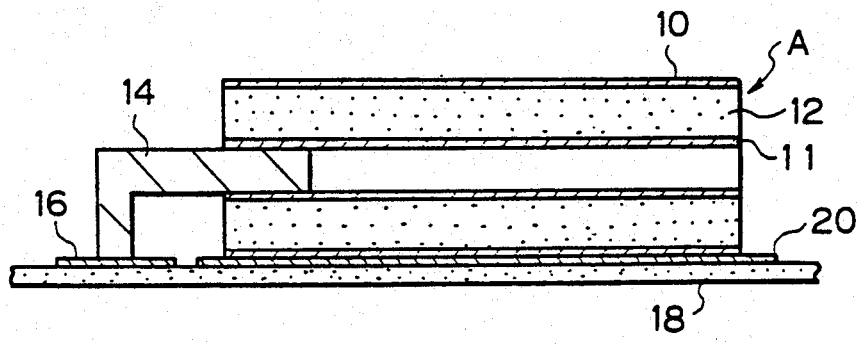
Fig. 2 PRIOR ART
FIG. 2 is a cross-sectional view of a λg/2 type resonator.
Figure 3:
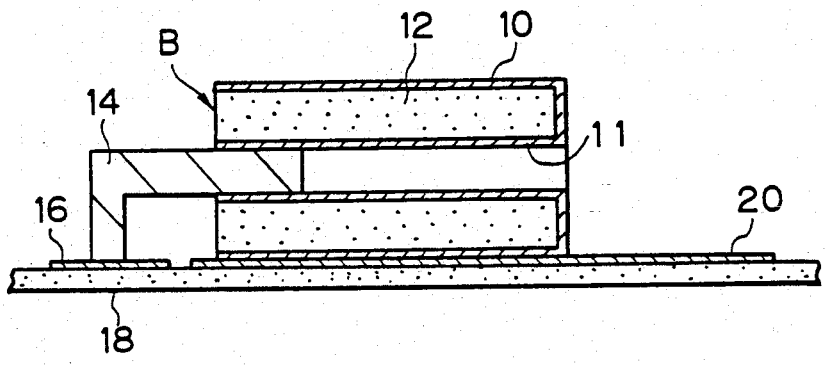
Fig. 3 PRIOR ART
FIG. 3 is a cross-sectional view of a λg/4 type resonator.

An example of a dielectric TEM resonator mounted on a circuit board is shown in FIGS. 1 to 3. FIG. 1 is a perspective view of the resonator, FIG. 2 is a cross-sectional view of the resonator of λg/2 type, and FIG. 3 is a cross-sectional view of the resonator of λg/4 type.

An outer conductor 10 and an inner conductor 11 are provided on an outer and an inner surface of a dielectric block 12 by metallization. The inner conductor 11 is connected through a drawing out member 14 to a conductor pattern 16 on a dielectric board 18. A conductor pattern 20 is provided for stabilization and the outer conductor 10 is bonded on the conductor pattern 20.

In the λg/2 type resonator, the inner conductor 11 is separated from the outer conductor 10 to provide an open end at the portion denoted by A as shown in FIG. 2. On the other hand, in the λg/4 type resonator, a conductor metallization applied on a face of the dielectric block 12 opposite to the face where the drawing out member 14 is provided, connects the inner conductor 11 to the outer conductor 10, and the open end is provided only at the portion denoted by B, as shown in FIG. 3.

In both types of resonators, a resonant frequency of the resonator is determined by the axial length of the resonator. Generally, dimensional accuracy of dielectric materials is not satisfactory and delicate differences in shapes of the drawing out member 14 remarkably affect the resonant frequencies, so that adjustments of the resonant frequencies are required in individual products after mounting of the resonators on the boards.

Figure 4:
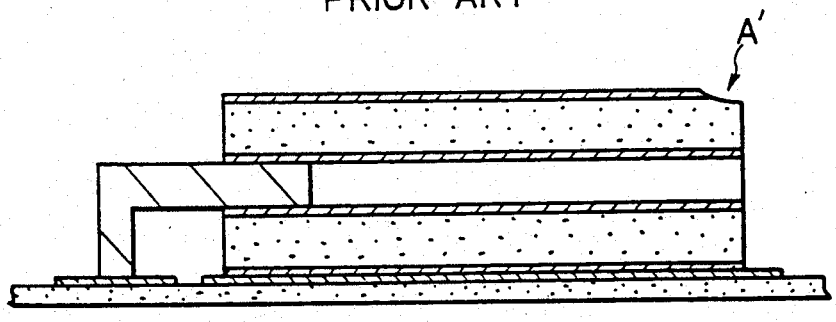
Fig. 4 PRIOR ART
FIG. 4 is a diagram for explaining a conventional adjusting method for a λg/2 type resonator.
Figure 5:
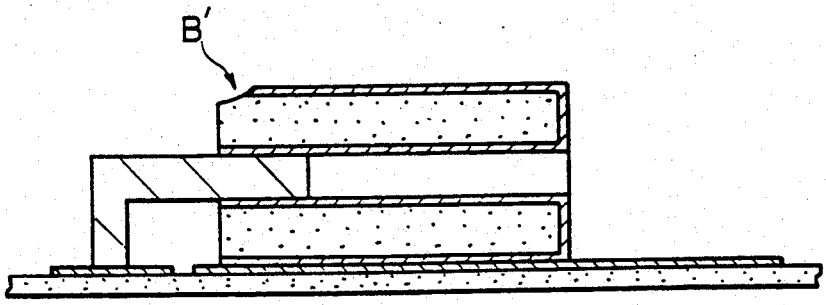
Fig. 5 PRIOR ART
FIG. 5 is a diagram for explaining a conventional adjusting method for a λg/4 type resonator.

FIGS. 4 and 5 are diagrams for explaining a conventional method for adjustment of the resonant frequencies. First, a dielectric resonator having a lower resonant frequency, i.e., a larger length than a required value, is made. After the dielectric resonator is mounted, the resonant frequency is adjusted by shaving off the outer conductor 10 with a file, etc., at the open end portion of the resonator, as shown by A' in FIG. 4 in the case of the λg/2 type, or as shown by B' in FIG. 5 in the case of the λg/4 type.

This adjustment method is troublesome and cannot lower the resonant frequency, as mentioned previously.

The preferred embodiments of the present invention will now be described with reference to the accompanying drawings.

Figure 6:
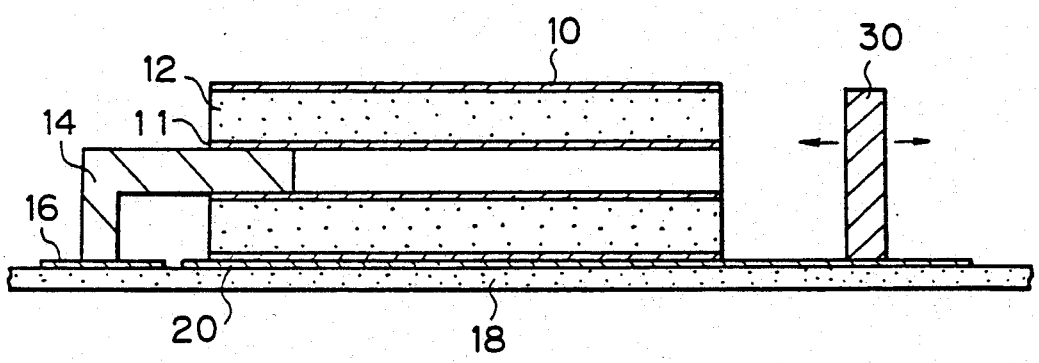
FIG. 6 is a cross-sectional view of a dielectric TEM resonator according to a first embodiment of the present invention.

FIG. 6 is a cross-sectional view of a dielectric TEM resonator according to a first embodiment of the present invention. In FIG. 6 and the figures referred to hereinafter, the same reference numerals as used in FIGS. 1 to 3 are used for constituents which are similar to those in FIGS. 1 to 3, and thus descriptions thereof are left out.

A metal chip 30 arranged adjacent to the open end of the resonator is soldered to the conductor pattern 20 which is bonded with the outer conductor 10. If the soldering position of the metal chip 30 is moved toward the resonator, the resonant frequency is elevated, and if the soldering position is moved away from the resonator, the resonant frequency is lowered. Adjustment of the soldering position is performed, for example, by a method wherein the metal chip 30 is soldered at a rough position and if an observed resonant frequency at that position is not satisfactory, the soldering position is moved by melting the solder, or by a method wherein the position of the metal chip 30 is adjusted observing the resonant frequency while the solder is held in a molten state.

Figure 7:
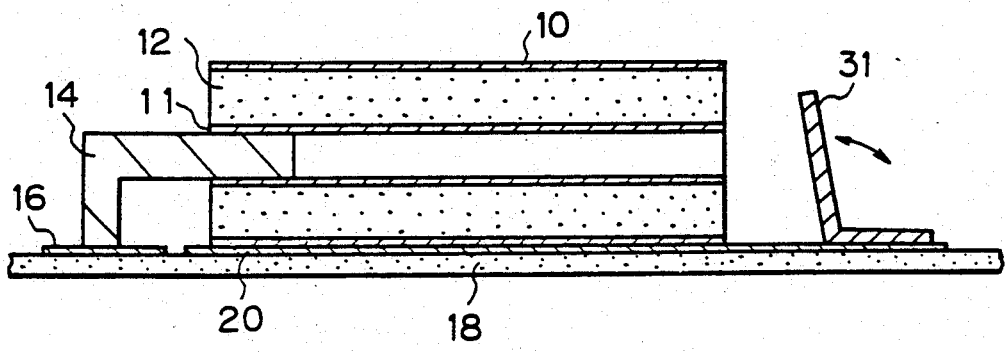
FIG. 7 is a cross-sectional view of a dielectric TEM resonator according to a second embodiment of the present invention.

FIG. 7 is a cross-sectional view of a dielectric TEM resonator according to a second embodiment of the present invention. A metal plate 31 has a portion bonded with the conductor pattern 20 and a bent portion which is not bonded with the conductor pattern 20.

A resonant frequency is adjusted by moving the bent portion toward or away from the open end of the resonator by adjusting a bending angle of the bent portion.

Figure 8:
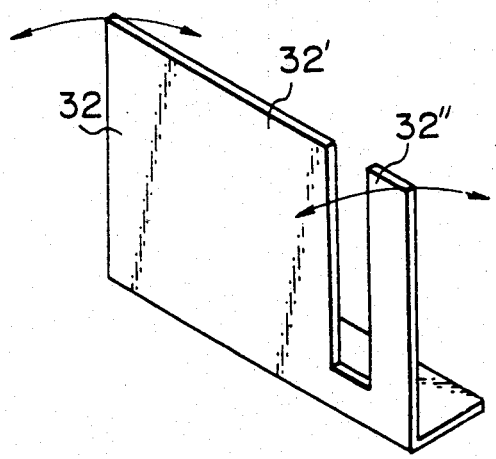
FIG. 8 is a perspective view of a metal plate used in a modification of the dielectric TEM resonator shown in FIG. 7.

FIG. 8 is a perspective view of a metal plate 32 which is used instead of the metal plate 31 of FIG. 7, in a modification of the dielectric TEM resonator of FIG. 7. The metal plate 32 has a bent portion 32' having a larger width and area and a bent portion 32" having a smaller width and area. The bent portion 32' provides rough adjustment of the resonant frequency and the bent portion 32" provides fine adjustment.

Figure 9:
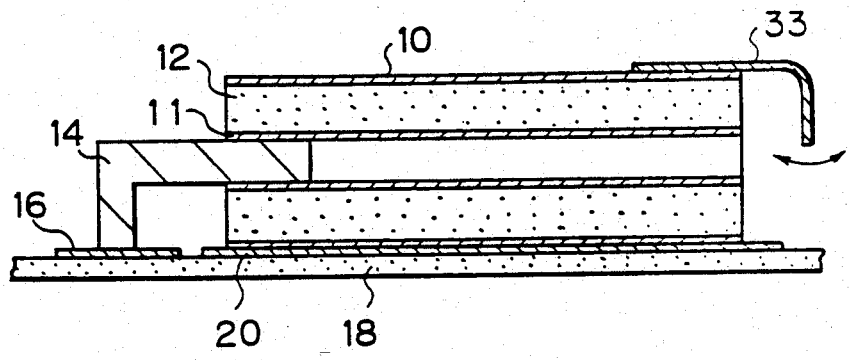
FIG. 9 is a cross-sectional view of a dielectric TEM resonator according to a third embodiment of the present invention.

FIG. 9 is a cross-sectional view of a dielectric TEM resonator according to a third embodiment of the present invention. A metal plate 33 has a portion bonded with an upper surface of the outer conductor 10, and is bent at the other portion which is not bonded. A resonant frequency is adjusted by adjusting a bend angle of the metal plate 33. In this embodiment, the metal plate may also have such a rough adjustment portion and a fine adjustment portion as in the embodiment of FIG. 8.

Figure 10:
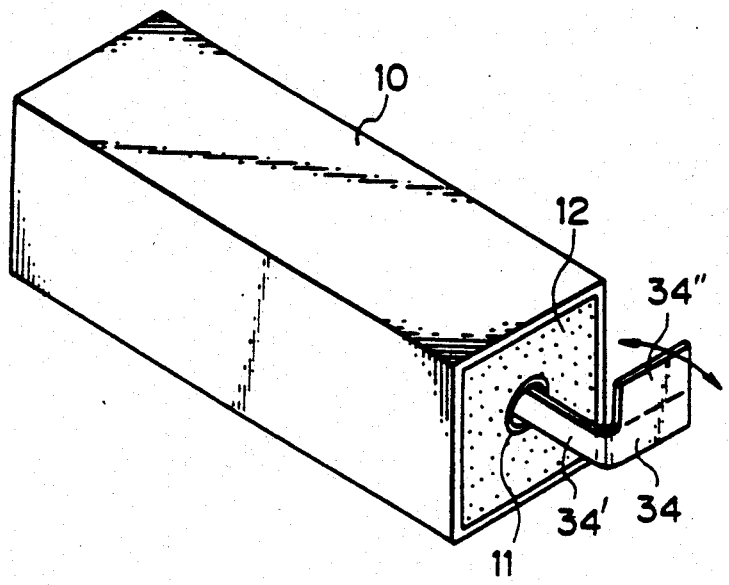
FIG. 10 is a perspective view of a dielectric TEM resonator according to a fourth embodiment of the present invention.

FIG. 10 is a perspective view of a dielectric TEM resonator according to a fourth embodiment of the present invention, which is viewed from an open end thereof. A metal plate 34 is bent at an approximately right angle, and a portion 34' of the metal plate 34 elongated along an axis of the resonator is inserted into an inner conductor 11 to be bonded with the inner conductor 11. A mean distance between a portion 34" elongated approximately in parallel to an end face of the resonator body and the resonator body itself can be adjusted by adjusting a bend angle of the metal plate 34, to adjust a resonant frequency. As indicated by the curved arrow, portion 34" is bent along the dotted line.

Figure 11:
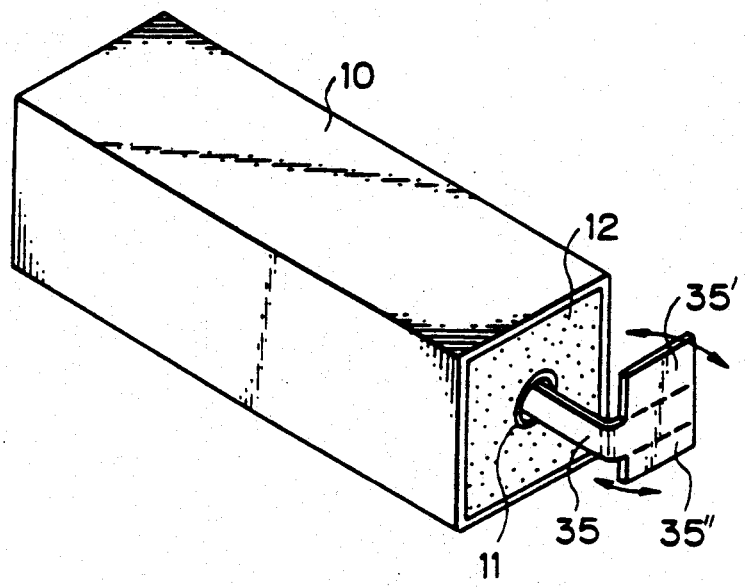
FIG. 11 is a perspective view of a modification of the dielectric TEM resonator shown in FIG. 10.

FIG. 11 is a perspective view of a modification of the resonator of FIG. 10. The resonator of FIG. 11 has a a metal plate 35. The metal plate 35 has a portion 35' and a portion 35". Both portions are elongated in parallel to an end face with portion 35" having a smaller area than that of the portion 35'. As indicated by the curved arrows, portions 35' and 35" are bent independently of on another along the dotted lines. The portion 35' provides rough adjustment of frequency and the portion 35" provides fine adjustment of frequency.

Although, in the aforementioned embodiments, the outer conductor 10 or the inner conductor 11 is directly connected to the metal chip 30 or metal plate 31 to 35, the present invention is not limited to the direct connection. The outer conductor 10 or the inner conductor 11 may be coupled with the metal chip or plate at least by high-frequency coupling, for example, by capacitive coupling through an insulating sheet.

Figure 12:
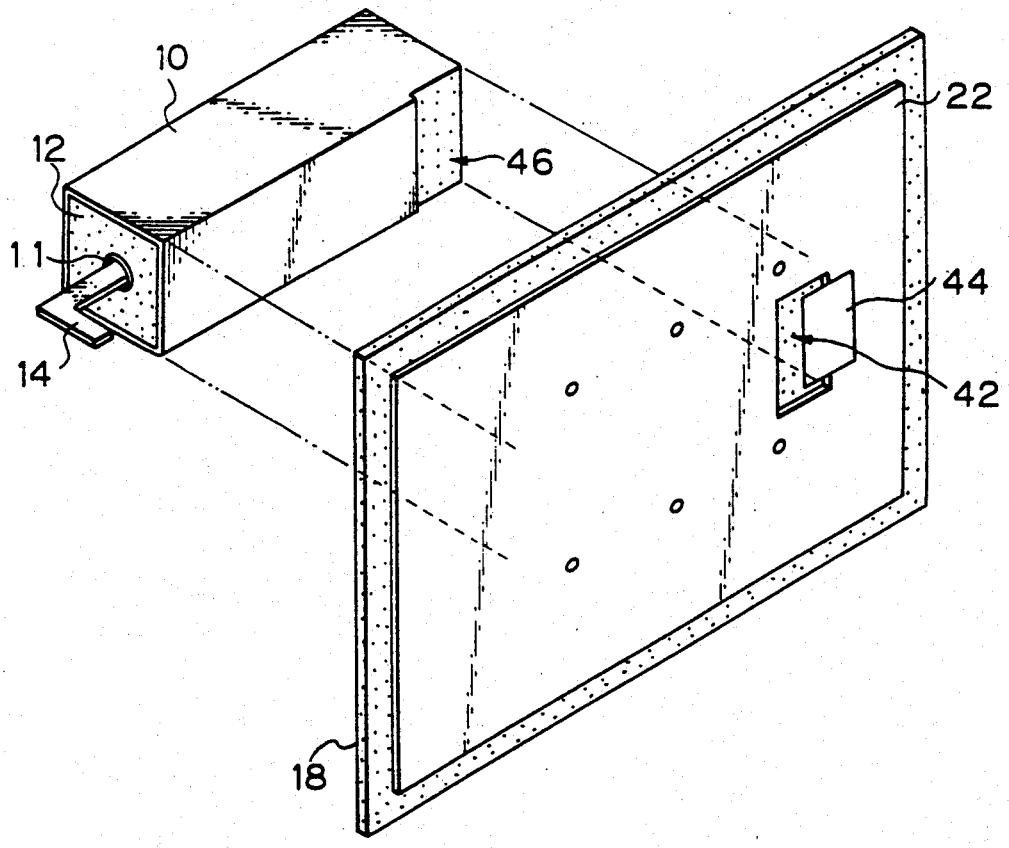
FIG. 12 is a separated perspective view of a dielectric TEM resonator according to a fifth embodiment of the present invention.
Figure 13:
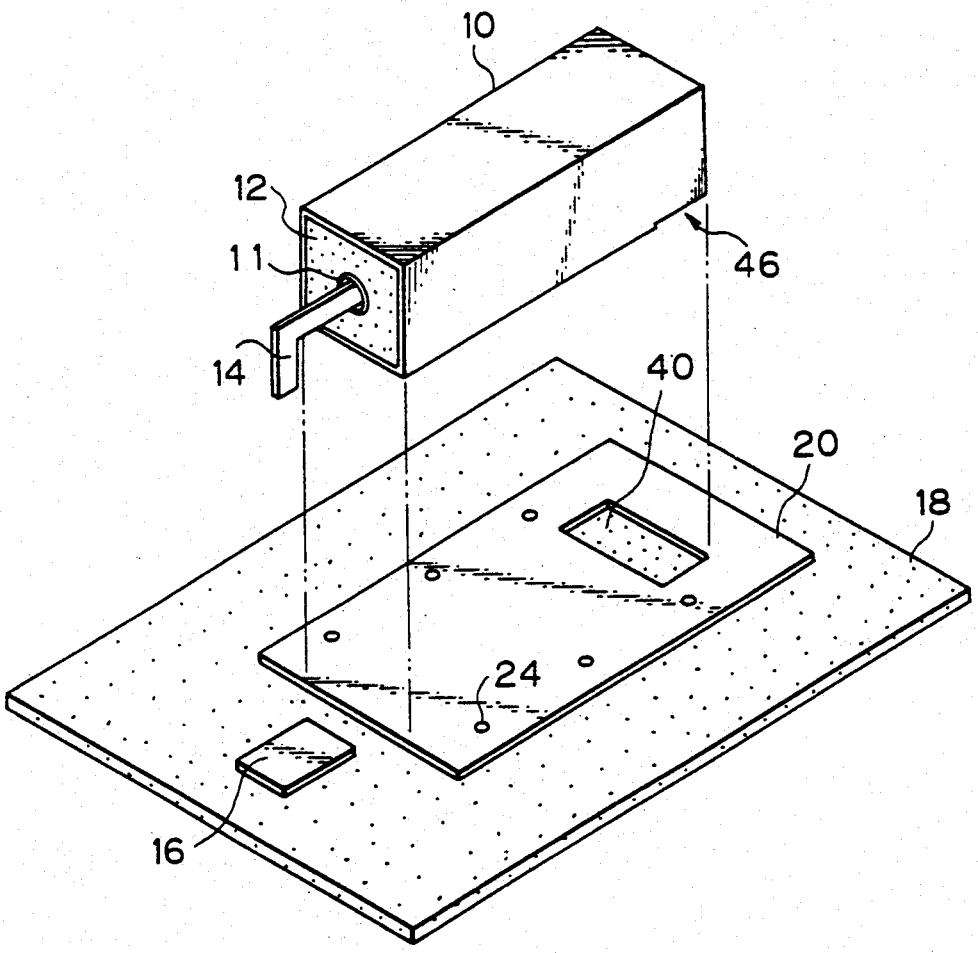
FIG. 13 is a separated perspective view of the dielectric TEM resonator of FIG. 12, viewed from another direction.
Figure 14:
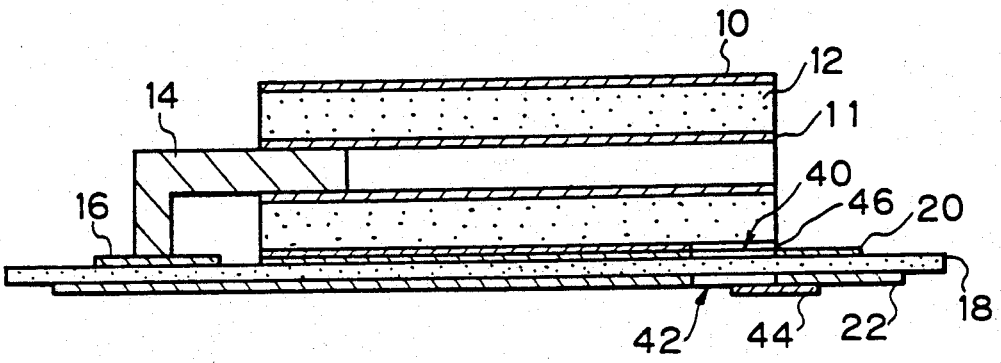
FIG. 14 is a cross-sectional view of the dielectric TEM resonator of FIG. 12.

FIGS. 12 to 14 show a dielectric TEM resonator according to a fifth embodiment of the present invention. FIG. 12 is a separated perspective view of the resonator viewed from the reverse side of the resonator, FIG. 13 is a separated perspective view of the resonator viewed from another side, and FIG. 14 is a cross-sectional view of the resonator.

A conductor pattern 20 is provided on the right side of a dielectric board 18 and a conductor pattern 22 is provided on almost all of a reverse side of the dielectric board 18. The conductor patterns 20 and 22 are connected through many through-holes 24 and provide an earth pattern. Though not shown, other circuit elements for a circuit including the dielectric resonator are arranged on the other surface of the dielectric board 18 than the surface where the conductor pattern 20 is arranged. For example, in the case where the dielectric resonator is used as an oscillating frequency stabilizer for a voltage controlled oscillator (VCO), other circuit elements for the VCO and a connecting pattern therefor are also provided.

A dielectric block 12 is exposed in a portion 46 near an end face opposite to the end face having a drawing out member 14 in a surface facing toward the conductor pattern 20. Exposed portions 40 and 42 are also provided at positions corresponding to the exposed portion 46 in the conductor patterns 20 and 22, respectively.

In addition, a copper sheet 44 covering a part of the exposed portion 42 is bonded with the conductor pattern 22. A resonant frequency is adjusted by moving a bonded position of the copper sheet 44. If the bonded position of the copper sheet 44 is moved so that an exposed area of the exposed portion 42 is decreased, the resonant frequency is lowered because the effective length of the resonator becomes large. Conversely, if the bonded portion of the copper sheet 44 is moved so that the exposed area of the exposed portion 42 is increased, the resonant frequency becomes high. The copper sheet 44 is preferably soldered with the conductor pattern 22, and is moved by melting the solder.

Figure 15:
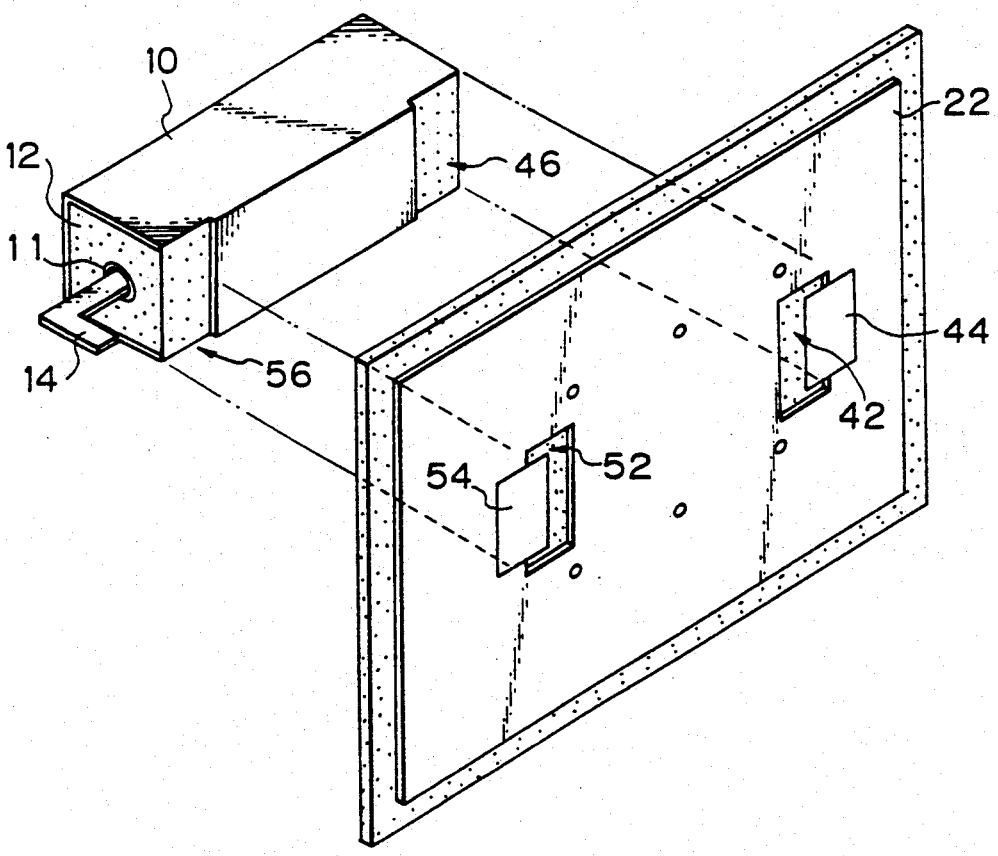
FIG. 15 is a separated perspective view of a dielectric TEM resonator according to a sixth embodiment of the present invention.
Figure 16:
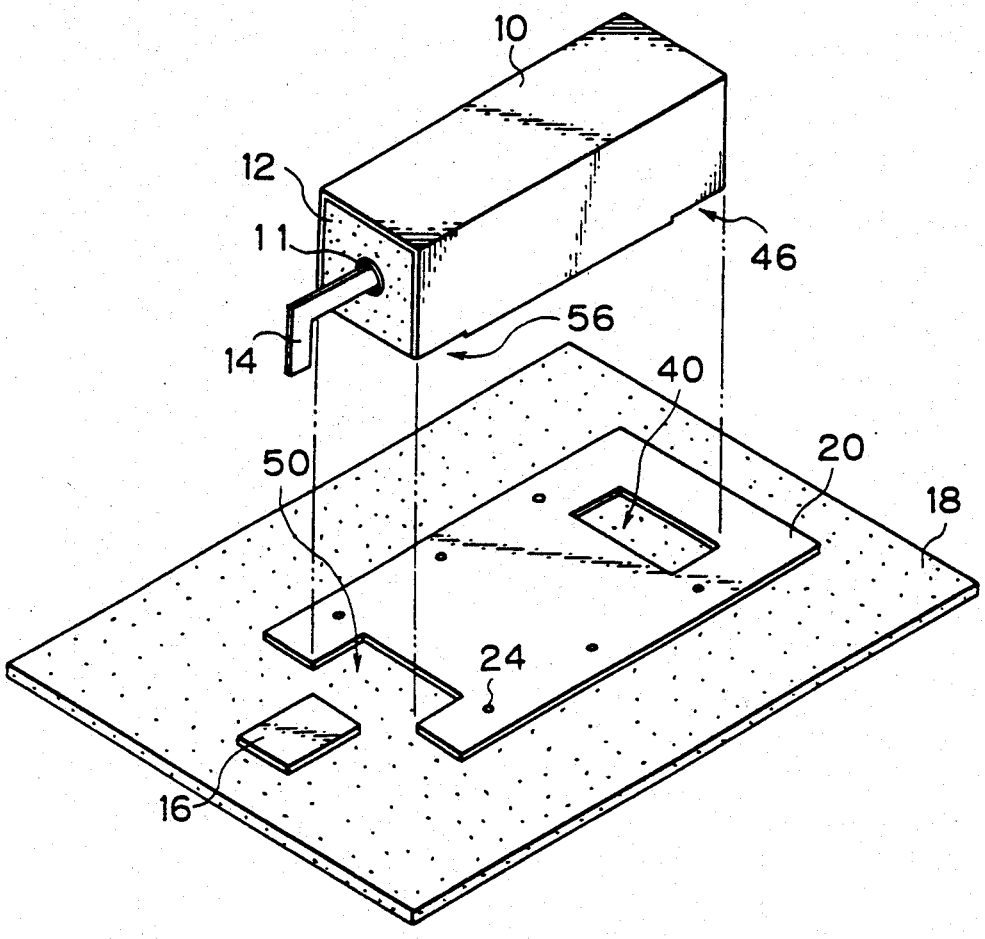
FIG. 16 is a separated perspective view of the dielectric TEM resonator of FIG. 15, viewed from another direction.
Figure 17:
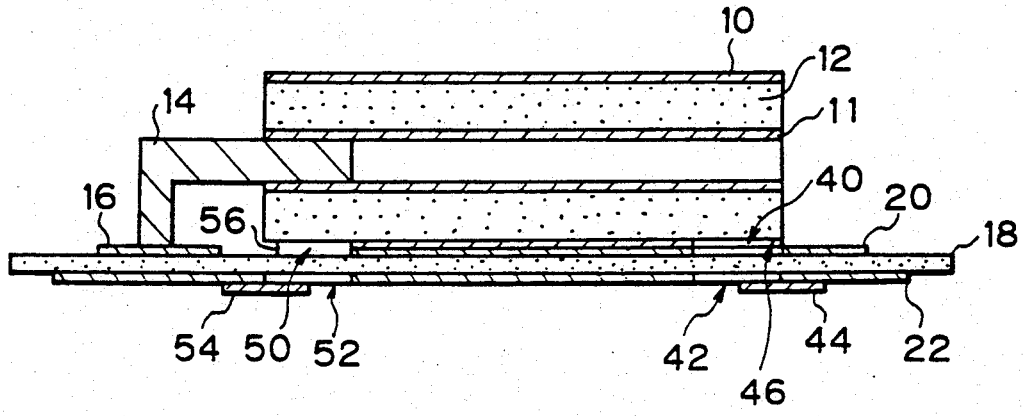
FIG. 17 is a cross-sectional view of the dielectric TEM resonator of FIG. 15.

FIGS. 15 to 17 show a dielectric TEM resonator according to a sixth embodiment of the present invention. FIGS. 15 and 16 are separated perspective views and FIG. 17 is a cross-sectional view, similar to FIGS. 12 to 14.

In this embodiment, an exposed portion 56 is provided on an opposite side of the exposed portion 46, and exposed portions 50 and 52 are provided at a position corresponding to the exposed portion 56 in the conductor patterns 20 and 22, respectively. In addition, a copper sheet 54 covering a part of the exposed portion 52 is bonded with the conductor pattern 22, for adjustment of the resonant frequency. This construction permits additional adjustment in the case where a variable range of the resonant frequency is not sufficient with only the copper sheet 44.

We claim:

1. A dielectric resonator comprising:

first conductor means, for operating as an inner conductor of the dielectric resonator;

second conductor means, spaced away from the first conductor means, for operating as an outer conductor of the dielectric resonator;

dielectric means filling the space between the first and second conductor means, for forming a resonator body having at least one open end, cooperating with the first and second conductor means; and third conductor means, disposed near the open end of the resonator body and electrically connected to the second conductor means, wherein a distance between the open end and at least a part of the third conductor means is adjustable to adjust a resonant frequency of the dielectric resonator.

2. A dielectric resonator as claimed in claim 1, further comprising fourth conductor means, bonded with the second conductor means and the third conductor means, to provide coupling between the second and third conductor means.

3. A dielectric resonator as claimed in claim 2, wherein the adjustment of the distance is performed by adjusting a bonding position of the third conductor means on the fourth conductor means.

4. A dielectric resonator as claimed in claim 3, wherein the third conductor means is a metal chip, wherein the fourth conductor means is a conductor pattern formed on a dielectric board, and wherein the resonator body and the metal chip are soldered on the conductor pattern.

5. A dielectric resonator as claimed in claim 2, wherein the third conductor means have at least a bent portion which is not bonded with the fourth conductor means, and wherein the adjustment of the distance is performed by adjusting a bending angle of the bent portion.

6. A dielectric resonator as claimed in claim 5, wherein the third conductor means is a metal plate, wherein the fourth conductor means is a conductor pattern formed on a dielectric board, and wherein the resonator body and a part of the metal plate are soldered on the conductor pattern.

7. A dielectric resonator as claimed in claim 5, wherein the third conductor means have a first bent portion and a second bent portion having a different area from that of the first bent portion.

8. A dielectric resonator as claimed in claim 1, wherein a part of the third conductor means is bonded with the second conductor means, wherein the third conductor means have at least a bent portion in a remaining part, and wherein the adjustment of the distance is performed by adjusting a bending angle of the bent portion.

9. A dielectric resonator as claimed in claim 8, wherein the third conductor means have a first bent portion and a second bent portion having a different area from that of the first bent portion.

10. A dielectric resonator as claimed in claim 9, wherein the third conductor means is a metal plate, and wherein a part of the metal plate is soldered with the second conductor means.

11. A dielectric resonator comprising:

first conductor means, for operating as an inner conductor of the dielectric resonator;

second conductor means spaced away from the first conductor means, for operating as an outer conductor of the dielectric resonator;

dielectric means filling the space between the first and second conductor means, for forming a resonator body having at least one open end, cooperating with the first and second conductor means; and third conductor means, having a portion longitudinally spaced a distance from the open end of the resonator body and electrically connected to the first conductor means, said third conductor means being adjustable to vary the distance between the open end and said portion of the third conductor means to adjust a resonant frequency of the dielectric resonator.

12. A dielectric resonator as claimed in claim 11, wherein the third conductor means have said portion bonded with the first conductor means and at least a bent portion, and wherein the resonant frequency is adjusted by adjusting the bending angle of the third conductor means.

13. A dielectric resonator as claimed in claim 12, wherein the third conductor means have a first bent portion and a second bent portion having a different area from that of the first bent portion.

14. A dielectric resonator comprising:

first conductor means, for operating as an inner conductor of the dielectric resonator;

second conductor means, spaced away from the first conductor means, for operating as an outer conductor of the dielectric resonator;

dielectric means filling the space between the first and second conductor means, for forming a resonator body, cooperating with the first and second conductor;

a dielectric board having first and second opposite sides, the first side being mounted to the resonator body; and a first conductor pattern covering the second side of the dielectric board, wherein the dielectric means are exposed out of the second conductor means in a first part of a face of the resonator body facing to the dielectric board, near an end face of the resonator body, wherein the dielectric board is exposed out of the first conductor pattern in a second part corresponding to the first exposed part, and wherein the dielectric resonator further comprises third conductor means covering at least a part of the second exposed part, and coupled with the first conductor pattern.

15. A dielectric resonator as claimed in claim 14, wherein the third conductor means is a metal plate soldered with the first conductor pattern.

16. A dielectric resonator as claimed in claim 15, further comprising a second conductor pattern formed on a resonator body side of the dielectric board and interposed between the resonator body and the dielectric board, wherein the dielectric board is exposed out of the second conductor pattern in a third part corresponding to the first and second exposed parts.

17. A dielectric resonator as claimed in claim 16, wherein the dielectric means and the dielectric board are also exposed out of the second conductor means and the first conductor pattern in a fourth and fifth part, respectively, near another end face of the resonator body, and wherein the dielectric resonator further comprises fourth conductor means covering at least a part of the fifth exposed part, and coupled with the first conductor pattern.

18. A dielectric resonator as claimed in claim 17, wherein the fourth conductor means is a metal plate soldered with the first conductor pattern.

19. A dielectric resonator as claimed in claim 18, further comprising a second conductor pattern formed on resonator body side of the dielectric board and interposed between the resonator body and the dielectric board, wherein the dielectric board is exposed out of the second conductor pattern in a third part corresponding to the first and second exposed parts and in a sixth part corresponding to the fourth and fifth exposed parts.

20. An adjusting method of a dielectric resonator comprising the steps of:

i) providing a resonator body comprising an inner conductor, outer conductor, and a dielectric material filling a space between the inner and outer conductor, ii) providing a conductor member disposed near an open end of the resonator body and electrically connected to the outer conductor, and iii) adjusting a distance between the open end and at least a part of the conductor member to adjust a resonant frequency of the resonator.

21. An adjusting method of a dielectric resonator comprising the steps of:

i) providing a resonator body comprising an inner conductor, outer conductor, and a dielectric material filling a space between the inner and outer conductor, ii) providing a conductor member having a portion longitudinally spaced a distance from an open end of the resonator body and electrically coupled to the inner conductor, and iii) varying the distance between the open end and said portion of the conductor member to adjust a resonant frequency of the resonator.

22. An adjusting method of a dielectric resonator comprising the steps of:

i) preparing a resonator body comprising an inner conductor, outer conductor, and a dielectric material filling a space between the inner and outer conductor, wherein the dielectric material is exposed out of the outer conductor in a part of a face of the resonator body, ii) preparing a dielectric board having a conductor pattern covering a side of the dielectric board wherein the dielectric board is exposed out of the conductor pattern in a part of the side of the dielectric board.

iii) mounting the resonant body on the side of the dielectric side opposite to the board covered with the conductor pattern, so that the exposed part of the dielectric material overlaps the exposed part of the dielectric board, iv) covering at least a part of the exposed part of the dielectric board with a conductor plate electrically connected to the conductor pattern, and v) adjusting the covered area of the exposed part of the dielectric board to adjust a resonant frequency of the dielectric resonator.

* * * * *

UNITED STATES PATENT AND TRADEMARK OFFICE

CERTIFICATE OF CORRECTION

PATENT NO. : 5,218,330

DATED : June 8, 1993

INVENTOR(S) : Kenzi OMIYA et al.

It is certified that error appears in the above-identified patent and that said Letters Patent is hereby corrected as shown below:

Col. 5, line 28, delete "a" (second occurrence);
Col. 5, line 30, change "in" to --and--; and
Col. 5, line 33, change "on" to --one--.

*Col. 10, line 4, change "side" to --board--; and
Col. 10, line 4, change "board" to --side--.

Signed and Sealed this

Sixteenth Day of August, 1994

*Attest:*

*Attesting Officer*

Bruce Lehman

BRUCE LEHMAN

*Commissioner of Patents and Trademarks*